United States Patent [19]

Yamade et al.

[11] Patent Number: 4,878,853

[45] Date of Patent: Nov. 7, 1989

[54] LOCKING DEVICE FOR CONNECTOR ASSEMBLY

[75] Inventors: Kenichi Yamade; Sukeyoshi Nakashima, both of Tokyo; Shigemitsu Inaba; Kazuto Ohtaka, both of Shizuoka, all of Japan

[73] Assignee: Yazaki Corporation, Tokyo, Japan

[21] Appl. No.: 327,675

[22] Filed: Mar. 23, 1989

[30] Foreign Application Priority Data

Mar. 23, 1988 [JP] Japan ..... 63-67318

[51] Int. Cl.[4] ..... H01R 13/639

[52] U.S. Cl. ..... 439/144; 439/372; 439/596

[58] Field of Search ..... 439/509, 510, 512, 513, 439/347, 370, 188, 372, 596, 603, 144, 490, 485, 488; 200/51

[56] References Cited

U.S. PATENT DOCUMENTS

| | | | |
|---|---|---|---|
| 3,192,500 | 6/1965 | West | 439/370 |
| 3,239,791 | 3/1966 | Furk | 439/144 |
| 4,253,718 | 3/1981 | Bungo | 439/603 |
| 4,350,403 | 9/1982 | Seytre et al. | 435/370 X |
| 4,607,903 | 8/1986 | Hoshino et al. | 439/370 |
| 4,674,814 | 6/1987 | Hoshino et al. | 439/386 |
| 4,750,893 | 6/1988 | Sueyoshi et al. | 439/596 |

*Primary Examiner*—William Briggs

*Attorney, Agent, or Firm*—Armstrong, Nikaido, Marmelstein, Kubovcik & Kubovcik

[57] ABSTRACT

A locking device for a connector assembly wherein a completely fitted or locked condition of connectors thereof can be confirmed clearly at a glance by way of an electric circuit. One of the connectors to be fitted with each other by the above locking device is provided with a locking plate for movement between a locking position and a releasing position, a holding element for holding the locking plate at the locking position, and also a means for confirming the connector fitted condition comprising a short-circuiting element and a pair of short-circuiting terminals so as to be connected with each other for assembling electric connection between the short-circuiting terminals.

6 Claims, 4 Drawing Sheets

LOCKING DEVICE FOR CONNECTOR ASSEMBLY

BACKGROUND OF THE INVENTION

1. Field of the Invention

The present invention relates to a locking device for a connector assembly interposed in a wire harness or the like for connection of an electric part of an automobile.

2. Prior Art

A connector assembly consisting of a pair of female and a male connectors to be fitted with and coupled to each other conventionally includes a locking device composed of a locking arm and an engaging projection which are provided one and the other of the connectors, respectively, and engaged with each other when a pair of metal terminal elements built in the connectors are brought into contact with each other. When the locking arm is engaged with the engaging projection, a specific operation feeling is provided, through which confirmation of such fitting can be readily attained.

However, such operation feeling readily varies in accordance with an aged deterioration or a change of the connector assembly by an atmosphere in which the device is used, and also such operation feeling itself lacks in reliability as a means for confirming such fitting. An improved locking device which eliminates such drawbacks as described just above is disclosed in U.S. Pat. No. 4,674,814.

A connector assembly in which the improved locking device is incorporated is shown in FIG. 6A. Referring to FIG. 6A, the connector assembly shown includes a pair of female and male connectors, respectively a and b, adapted to be fitted with each other. A locking piece d is formed for pivotal motion by way of a hinge portion e at a rear end of an upper wall c of the female connector a. When the locking piece d is pivoted to a position on the upper wall c and pressed against the latter by some means not shown here, an arresting projection f of the locking piece d is forced into a terminal accommodating chamber h by way of a hole g formed in the upper wall c.

The male connector b has an arresting recess i formed in the upper wall thereof. When the female and male connectors a and b are fitted fully with each other, the arresting projection f of the locking piece d of the female connector a is caught by the arresting recess i of the male connector b. Accordingly, confirmation of such fitting between the connectors a and b can be obtained as soon as they are locked with each other (FIG. 6B). If the female and male connectors a and b are not fully fitted with each other, then the arresting projection f will not be perfectly caught by the arresting recess i and consequently the locking piece d of the female connector a cannot be closed fully to the position on the upper wall c. Accordingly, such incomplete fitting between the female and male connectors a and b can be easily recognized (FIG. 6C).

Even with the use of the prior art connector assembly described just above, it is still necessary for an operator to move the locking piece to its predetermined position, and in fact it is very possible that the assembling operation may be completed with the female and male connectors left in an incompletely fitted condition with each other by mistakes or some other reason.

SUMMARY OF THE INVENTION

It is an object of the present invention to provide a locking device for a connector assembly wherein a completely fitted or locked condition of connectors thereof can be confirmed clearly at a glance by way of an electric circuit.

In order to attain the object, the present invention provides a locking device for a connector assembly which includes a pair of connectors adapted to be fitted with each other, wherein one of the connectors is provided with a locking plate for movement between a locking position and a releasing position, and a holding element for holding the locking plate at the locking position, whereas the other connector is provided with a locking element to be engaged with the locking plate to lock the connectors with each other when the both connectors are completely fitted, characterized in that the first connector also includes a means for confirming fitting of the connectors, which is composed of a short-circuiting element provided on the locking plate, and a pair of short-circuiting terminals provided on a supporting plate facing to the short-circuiting element so as to be connected with each other for assembling electric connection between the short-circuiting terminals.

With the connector assembly, if the pair of connectors are manually operated to be fitted fully with each other and then the locking plate is manually operated to move from the releasing position to the locking position, then the short-circuiting element is brought into contact with the short-circuiting terminal to short-circuit the electric circuit of the connector fitting confirming means. Thereupon, the connector fitting confirming means indicates that an intended locked condition between the pair of connectors is reached, and accordingly a fitted condition between the connectors can be readily confirmed and with certainty. Besides, since the locked condition between the connectors established by the locking plate and the locking element is held by the engagement between the locking plate and the holding element, the locked condition is maintained with a high degree of reliability.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
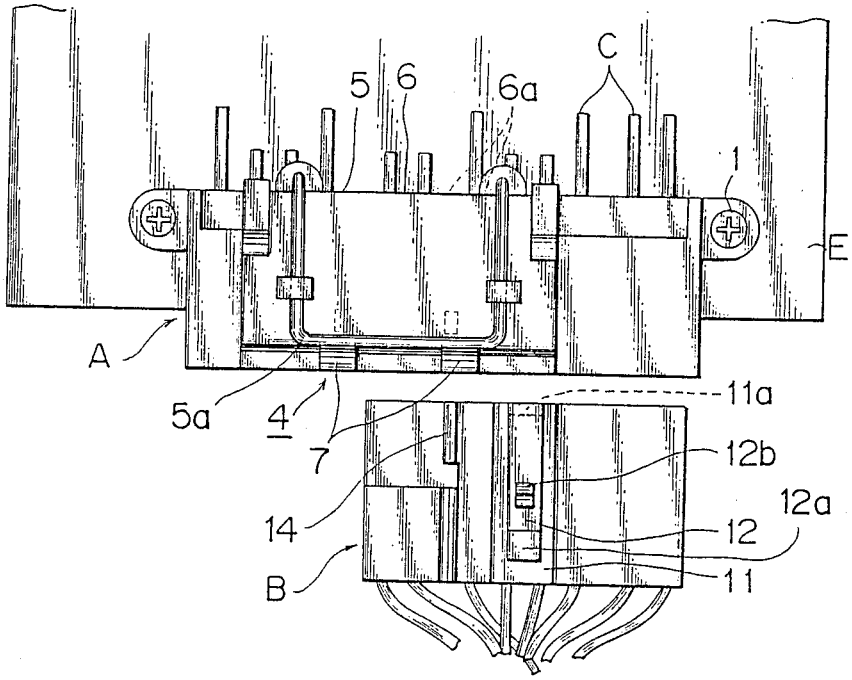
FIG. 1 is a top plan view of a connector assembly according to the present invention showing female and male connectors in a disassembled condition.
Figure 2:
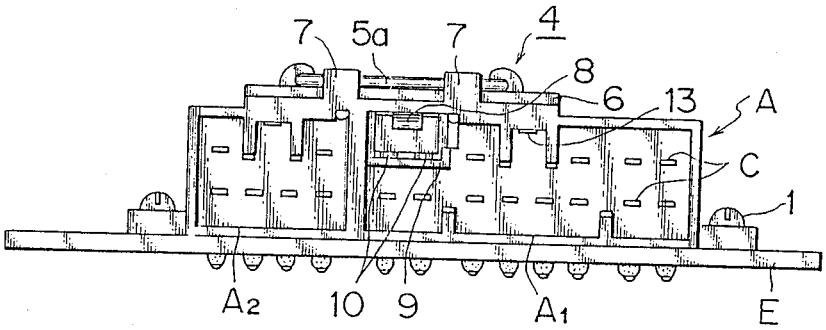
FIG. 2 is a front elevational view of the female connector of FIG. 1.

Referring to FIGS. 1 to 5, there is shown a connector assembly in which a locking device according to the present invention is incorporated. The connector assembly shown includes a female connector generally denoted at A and a male connector generally denoted at B. The female connector A has a plurality of pin-like male terminal C built therein while the male connector B has a plurality of female terminals D built therein. The female connector A is securely fixed to a printed circuit board E by means of a pair of bolts 1, and the pin-like male terminals C are soldered at outer ends thereof to a printed circuit 2 as at 3 on the printed circuit board E.

The female connector A has a 12-polar female connector portion $A_1$ and a 6-polar female connector portion $A_2$, and further has a locking mechanism 4 common to both the connector portions $A_1$ and $A_2$. The locking mechanism 4 comprises a locking plate 6 securely fixed to a resilient support arm 5 made of a metal material, and a pair of holding portions 7 for holding the locking plate 6 at a locking position. A pair of engaging projections 6*a* are provided on the inner face of the locking plate 6 for engaging respectively with the corresponding portions of the male connector B and another male connector (not shown) so as to be fitted with the female connector portions $A_1$ and $A_2$, and a short-circuiting piece 8 in the form of a bent plate made of a resilient metal material is provided also o the inner surface of the locking plate 6. A pair of short-circuiting terminals 10 are disposed on a supporting plate 9 of the female connector $A_1$ in an opposing relationship to the short-circuiting element 8 on the locking plate 6 such that, when the locking plate 6 is at its locking position, the short-circuiting element 8 may contact with and establish electric connection between the short-circuiting terminals 10. Also the short-circuiting terminals 10 are soldered at the other end portions thereof to another printed circuit 2' on the printed circuit board E. When the short-circuiting terminals 10 are short-circuited, the circuit 2' energizes a confirmation lamp of a connector fitting confirmation circuit (not shown) to be lit.

The holding portions 7 are formed on the female connector A, and each of the holding portions 7 has a hook-like configuration and also has a tapered engaging guide face 7*a*. The resilient support arm 5 is formed from a metal wire having opposite ends secured to the female connector A and is normally urged by its own resiliency to make an engaging end or cross bar 5*a* thereof into contact with the tapered engaging guide surfaces 7*a* of the holding portions 7 before the female and male connectors A and B are fitted with each other.

It is to be noted that in FIG. 1, only the multipolar male connector B for fitting with the female connector portion $A_1$ is shown while another male connector to be fitted with the female connector portion $A_2$ is omitted.

The male connector B has a groove 11 formed in an upper wall thereof, and a flexible locking piece 12 in the form of a cantilever having a rising base portion 12*a* at a forward end thereof is provided in the groove 11 as well known in the art. When the male connector B is fitted with the female connector portion $A_1$ of the female connector A, an arresting projection 12*b* on the flexible locking piece 12 of the male connector B is engaged with an arresting portion 13 of the female connector portion $A_1$ to lock the coupled condition of the female and male connectors A and B.

Figure 3:
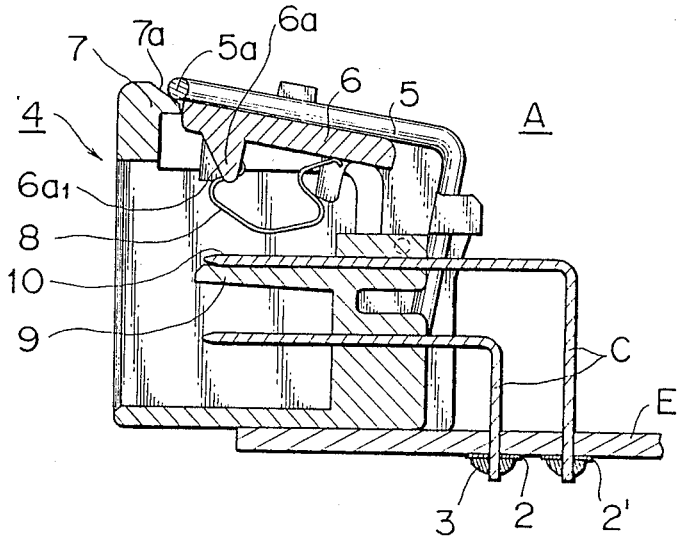
FIG. 3 is a sectional view, in a somewhat enlarged scale, of the female connector of FIG. 1.
Figure 4:
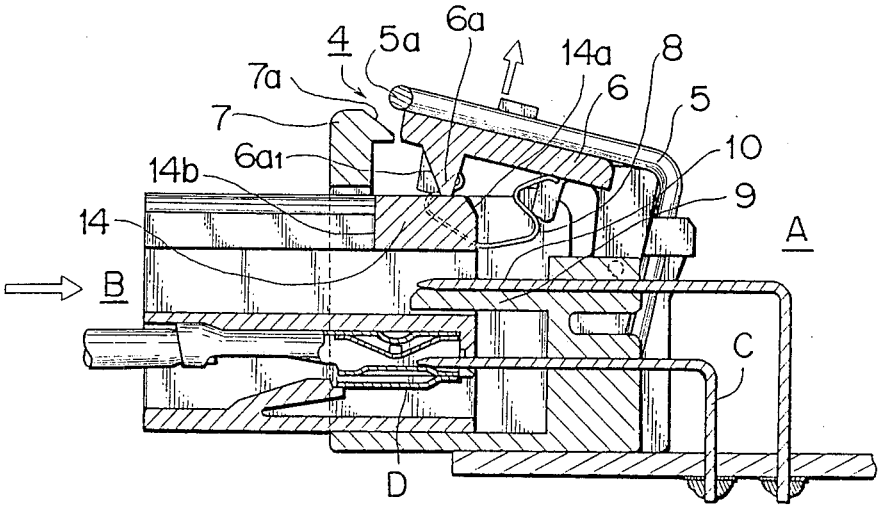
FIG. 4 is a sectional view showing the female and male connectors of FIG. 1 in the course of fitting movement thereof toward each other.
Figure 5:
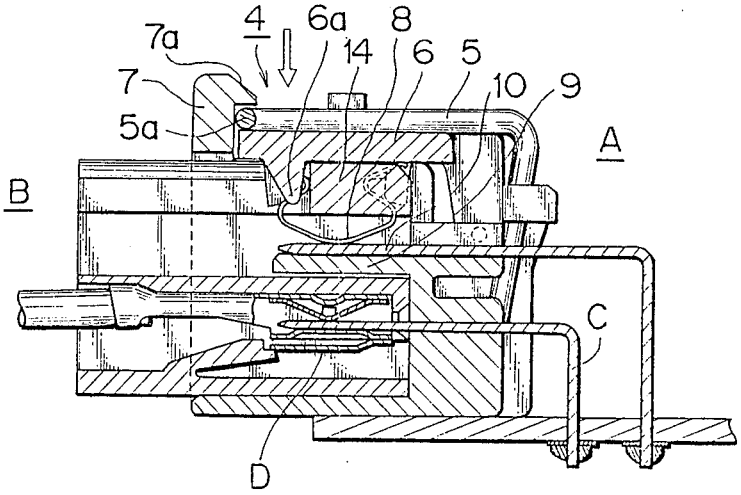
FIG. 5 is a sectional view showing the female and male connectors of FIG. 1 in a completely fitted condition.
Figure 6A:
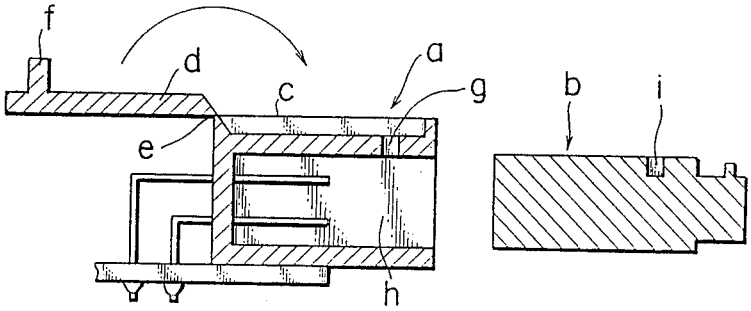
FIG. 6A PRIOR ART
FIGS. 6A, 6B and 6C are sectional views of a conventional connector assembly when female and male connectors thereof are respectively in a separated condition, a completely fitted condition and an incompletely fitted condition.
Figure 6B:
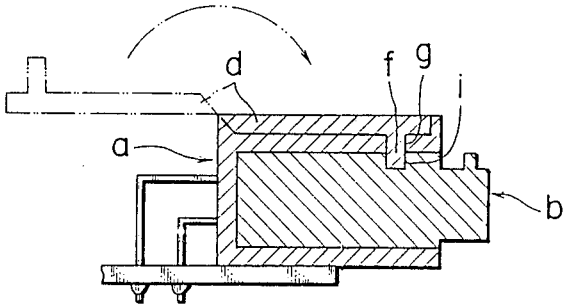
FIG. 6B PRIOR ART
Figure 6C:
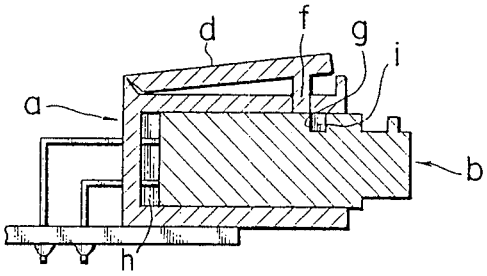
FIG. 6C PRIOR ART

A locking portion 14 is further provided on the upper wall of the male connector B. If the male connector B is manually operated to be fitted with the female connector A, a front end 14*a* of the locking portion 14 of the male connector B is abutted with a tapered guide face $6a_1$ of the engaging projection 6*a* in such a condition as shown in FIG. 3 while it is advanced into the female connector A (FIG. 4).

In order to attain a locked condition between the female and male connectors A and B, the engaging end 5*a* of the resilient support arm 5 of the locking mechanism 4 is pushed down, in a condition wherein the male connector B is fully fitted in the female connector A, until the engaging projection 6*a* is engaged with a shoulder 14*b* at a rear end of the locking portion 14 of the male connector B and arrested at the same time by the arresting portions 7 of the female connector A. When such a locked condition is established, the short-circuiting piece 8 is brought into contact with the short-circuiting terminals 10 to short-circuit the electric circuit of the connector fitting confirmation means such as a lamp to operate the same.

When the male connector B is to be disconnected from the female connector A, the engaging end 5*a* of the resilient support arm 5 should compulsorily disengaged from the arresting projection 7 using a jig, so that the male connector B is pulled off from the female connector A afterwards.

Having now fully described the invention, it will be apparent to one of ordinary skill in the art that many changes and modifications can be made thereto without departing from the spirit and scope of the invention as set forth herein.

What is claimed is;

1. A locking device for a connector assembly for enabling an operator to confirm the complete connection between a first connector and a second connector so as to gain electric connection, locking said connected state at the same time, wherein said first connector comprises;

a locking plate to be moved between a connector locking position and a releasing position;

a holding element for holding said locking plate at said locking position;

a short-circuiting element provided on said locking plate; and a plurality of short-circuiting terminals provided on a supporting plate opposing to said short-circuiting element, while said second connector comprises a locking element to be engaged with said locking plate, said short-circuiting element being brought into contact with said short-circuiting terminals when said connectors are in a mutually locked condition.

2. A locking device for a connector assembly as claimed in claim 1, wherein said locking plate is securely mounted on a resilient support member mounted for resilient pivotal motion.

3. A locking device for a connector assembly as claimed in claim 2, wherein said holding element has a tapered engaging guide face formed thereon for engaging, when said locking plate is moved from said releasing position to said locking position, with said locking plate so as to guide said locking plate to said locking position.

4. A locking device for a connector assembly as claimed in claim 3, wherein said resilient support member is formed from a metal wire and has a cross bar for engaging with said tapered engaging guide face of said holding element.

5. A locking device for a connector assembly as claimed in claim 1, wherein said short-circuiting element is formed as a resilient metal plate.

6. A locking device for a connector assembly as claimed in claim 1, wherein said plurality of short-circuiting terminals are electrically connected directly by said short-circuiting element when said connectors are in a locked condition.

* * * * *